United States Patent [19]

Tyson

[11] 4,077,243

[45] Mar. 7, 1978

[54] KEYHOLDER

[76] Inventor: Youree Tyson, P.O. Box 491, Eunice, La. 70535

[21] Appl. No.: 695,558

[22] Filed: Jun. 11, 1976

[51] Int. Cl.[2] ..... A44B 15/00

[52] U.S. Cl. ..... 70/459

[58] Field of Search ..... 70/456 R, 456 B, 457, 70/458, 459; 24/3 K; 150/40

[56] References Cited

U.S. PATENT DOCUMENTS

| | | | |
|---|---|---|---|
| 188,448 | 4/1905 | Wolfermann | 70/459 |
| 2,694,844 | 11/1954 | Grumbach | 70/459 |
| 2,823,537 | 2/1958 | Segal | 70/459 |

FOREIGN PATENT DOCUMENTS

| | | | |
|---|---|---|---|
| 36,853 | 5/1955 | Poland | 70/459 |

*Primary Examiner*—Robert L. Wolfe

*Attorney, Agent, or Firm*—Cushman, Darby & Cushman

[57] ABSTRACT

An easily fabricated low cost keyholder which consists of a body portion formed from a rod shaped so that the body portion has a loop structure at each end and a narrowed center portion. A single opening is provided in the narrowed central portion and a closing member is slidingly retained within that narrowed central portion. The closing member is of a length sufficient to close the opening in the narrowed portion yet allow keys to be placed on or removed from either one of the loop structures.

8 Claims, 8 Drawing Figures

Fig. 1.
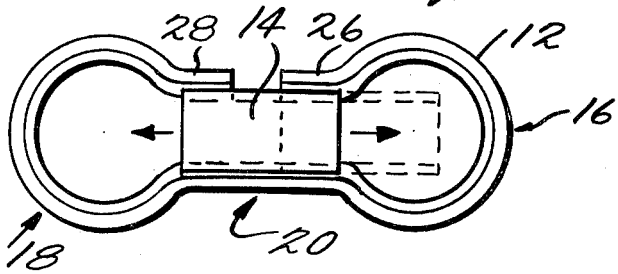
Fig. 2.
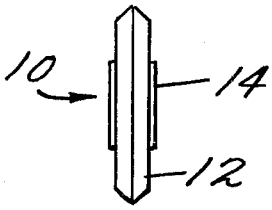
Fig. 3.
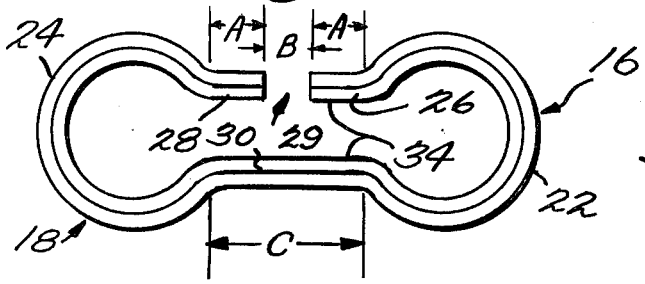
Fig. 4.
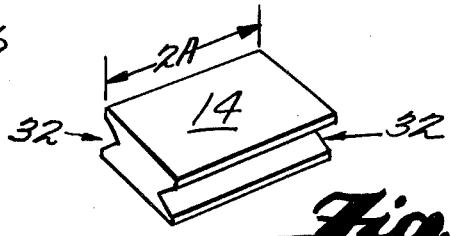
Fig. 5.
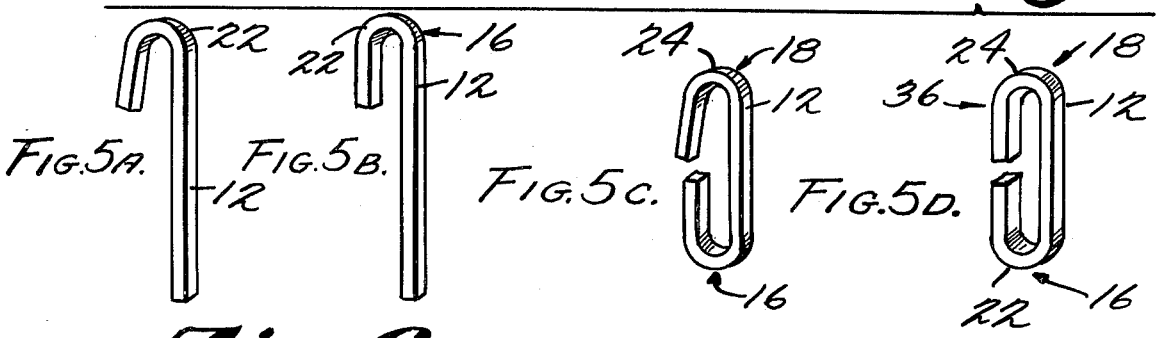
Fig. 6.
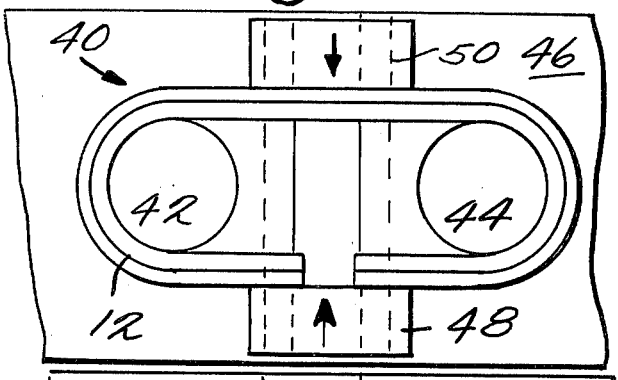
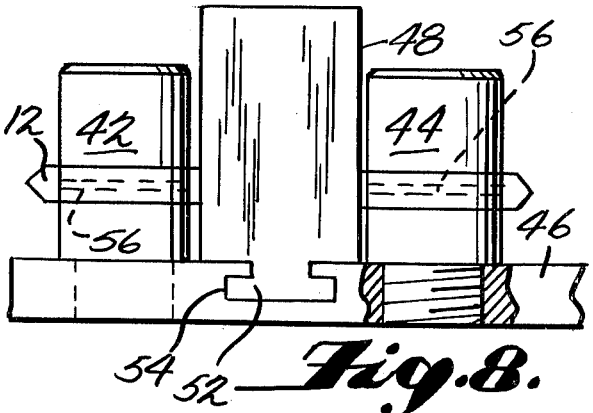
Fig. 8.
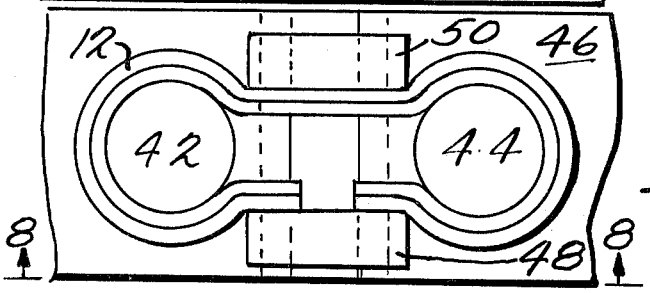
Fig. 7.

KEYHOLDER

BACKGROUND OF THE INVENTION

The present invention relates to an improved and very practical keyholder. The keyholder is comprised of only two pieces, one comprising the main body of the keyholder, the other being a slidable closure member. The main body portion is provided with a single opening allowing keys to be placed on and removed from the keyholder. The closure member has the function of controlling access to that single opening and for retaining keys on the keyholder.

It has been previously pointed out in the prior art that if a keyholder is to meet with acceptance, it must be simple in design, so as to provide for simple operation and yet it must also be easily constructed so as to minimize production costs. In addition, once the keys have been placed on the keyholder, the closure device must be held securely in its closed condition so that the keys will be retained and not lost.

Keyholders have been known in the prior art which rely on slidable type closure devices. An example of one such sliding keyholder is shown in Ryder, Jr., et al, U.S. Pat. No. 3,513,675. As shown, the Ryder keyholder consists essentially of a flat tubular outer casing open at both ends. A one piece strip is slidably received therein and is formed into essentially two U-shaped looped portions with an opening being provided along one side to allow access to each of the loop structures. When the one piece structure is centered within the outer casing, the opening in the one piece structure is likewise centered within the casing and thus closed. With the slidable tubular casing in its closed position, a U-shaped loop projects from each end of the outer casing and, depending on how the casing is moved one or the other of the U-shaped loops can be opened.

A projection is provided on one of the ends of the one piece strip adjacent the opening so as to form a locking device when it fits within a mating opening cut in the outer casing. In order to move the outer casing so as to open the device, the portion of the strip containing the projection must be depressed which is permitted since the strip material is of a springy nature. Applicant is of the belief that over a period of time such use would cause the locking mechanism to misfunction, thereby allowing the slidable outer casing to be easily moved.

Further, the tubular casing is provided with an abutment pin which together with projections on the one piece strip act as a stop for the sliding movement of the casing. Therefore, both the one piece strip and the casing require numerous manufacturing steps.

Other examples of key clips wherein slidable cases have been shown used are Sherman, U.S. Pat. No. 3,715,900, Murray, U.S. Pat. No. 2,129,436, Merrill, U.S. Pat. No. 905,731, Reed, U.S. Pat. No. 855,530, and French Pat. No. 596,975.

In each one of the above patents, the material forming the loop on which keys are retained is slidably disposed within a sleeve type closure device, so that the aperture formed in the loop material which allows keys to be added on and removed from that loop material accomplished by enclosing the portions of the loop where the opening is positioned within a sleeve arrangement and various types of locking devices and the purpose of which has been indicated as being to attempt to retain the sleeve closure in its closed position.

The present invention provides a device which is far simpler to use and to construct, and does not require any additional holding or locking mechanism to retain the slidable member in a closed position. In addition, the retention of the closure member in its closed position is assisted by the keys or other items that are placed within the loops of the device.

In forming the present invention a single piece of strip material, such as one eighth inch square bar stock, about eight inches in length, is bent into a flattened C-shape so as to form two end loops separated by a narrowed central section. The two ends of the bar are separated from each other along one side of that central portion thereby defining an aperture therebetween.

The size of the aperture in the central portion of the keyholder is less than the distance across the loops. The strip has been narrowed along its central portion so that a sliding closure member can be retained therein so as to control access to that aperture.

To place keys on one of the two loops, the slidable closure member is moved toward the opposite loop until the full length of the aperture in the central portion is exposed. When in this open position, slidable closure member continues to be engaged by portions of the bar forming the sides of that narrowed central portion of the strip member and the resiliency of the strip material of which the bar is comprised holds the sliding closure member in that open position.

After the keys have been placed on the desired loop, movement of the slidable closure member is reversed toward that loop on which keys have been placed until it is again centered within the central portion of the holder. When in this position, the opening in the central portion is again closed.

Various other and more detailed objects and advantages of the invention, such as arise in connection with carrying out the above-noted ideas in a practical embodiment will become more readily apparent and will at least in part be hereinafter stated as the specific detailed description of the invention proceeds.

For a full and more complete understanding of the invention, reference may be had to the following description and the accompanying drawings wherein:

FIG. 1 is a plan view of the keyholder according to the present invention and depicts the keyholder in a closed condition;

FIG. 2 is an end view of FIG. 1;

FIG. 3 shows a front elevational view of the body portion of the present invention;

FIG. 4 is a perspective view of the slidable closure member;

FIG. 5 shows the various forming phases of the keyholder;

FIG. 6 is a top plan view of the vice-mounted squeeze pin and block assembly prior to the blocks being squeezed together;

FIG. 7 shows a top plan view of the vice-mounted squeeze pin and block assembly following movement of the blocks;

FIG. 8 is a view taken along line 8–8 in FIG. 7.

Referring now to the drawings, wherein like reference numerals denote identical corresponding parts, the keyholder 10 shown in a closed position in FIG. 1 is comprised of two parts, a bar of strip material 12 and a slidable closure member 14.

The bar 12 is formed so as to provide loops 16 and 18 at either end thereof, and a narrowed central portion generally indicated at 20.

As best shown in FIG. 2, loops 16 and 18 are comprised of bent areas 22 and 24, respectively. Each of the loops 16 and 18 is provided with a short leg 26 and 28, respectively, which are not joined together, but rather are spaced apart so that a gap indicated at 29, is formed therebetween on one side of the narrowed central portion 20. Along the opposite side of the narrowed central portion 20 the loops 16 and 18 are integrally joined together by a portion of the strip 12 indicated at 30.

The central section 20 of the keyholder 10 is formed from the legs 26 and 28 and the strip 30. As will be described hereinafter, these portions of the keyholder 10 have been narrowed or squeezed inwardly so as to form the narrowed central section 20. The central portion 20 has been narrowed so that the distance between the short legs, 26 and 28, and strip 30 is approximately one-half the width of the interior portion of loops 16 and 18.

The slidable closure member 14 as shown in FIG. 1, is slidably retained within the central section 20 due to the springy nature of the bar 12 and developed by the legs 26 and 28 and the strip 30. As shown in FIG. 4, the closure member 14 can comprise a solid block having a substantially rectangular shape and provided with a channel or groove 32 formed in each long side thereof. It should be understood that the channel or groove 32 formed in the closure member 14 will depend upon the particular cross section of the bar 12 used to form the keyholder 10. Preferably, the bar 12 will be a piece of square metal stock which has been formed into the shape shown by being bent on its lineal edge, as shown in FIG. 2, but other cross-sectional shapes could also be employed (i.e. circular, hexagonal). Thus, the groove 32 is preferably a V-groove as is shown in FIG. 2. However, the shape of the groove 32 closure member 14 will be formed so as to correspond with the shape of the bar 12 in the central section 20 of the keyholder 10.

Referring now to FIG. 3, the interior edge surfaces 34 of the bar 12 which form the central section 20 are substantially parallel. The inner edges of the short legs 26 and 28 are of a length A, which is substantially equal to one-half the length of the closure member 14.

The gap 29, defined between the free ends of legs 26 and 28, respectively, is of a distance B or approximately equal to one-quarter the length of the closure member 14.

The opposite side of the central section 20 of the keyholder 10, formed by the strip 30, has a length C which corresponds to the length of the closure member 14 plus the length B of the gap 29 defined between the legs 26 and 28. Thus, when the closure member 14 is in its open position, as shown in dotted lines in FIG. 1, the closure member 14 is supported by leg 26 and a portion of strip 30. Since the interior surfaces of legs 26 and 28 are equal to approximately one-half of the length of the closure member 14 and since the strip 30 is equal to the length of the closure member 14 plus the distance B corresponding to the width of the gap 29 formed between legs 26 and 28, the closure member 14, when in its open position, continues to be supported along half its length. Because of this support, the closure member 14, when opened, remains securely held within the keyholder 10. Because the material comprising the bar 12 is of a springy or resilient material the forces applied against the closure member 14 by either of the short legs 26 and 28 and strip 30 will prevent the closure member from slipping out as keys are being added to or removed from either one of the loops 16 or 18.

The bar 12 and the closure member 14 may be constructed from any appropriate material although metals such as aluminum, brass, copper and stainless steel are the preferred materials.

Additionally, materials such as high impact plastics could equally as well be used to form both the bar 12 and the closure member 14. Further the two components could be equally well formed by casting or molding process, rather than by the bending process described hereinafter.

It is essential only that the bar 12 have a resiliency so as to provide a squeezing force against the closure member 14 when closure member 14 is placed within the central portion 20 of the keyholder 10 as shown in FIG. 1.

Turning now to FIG. 5, various stages of production of the keyholder 10 are shown. A straight piece of metal stock for bar 12 of the desired cross section, preferably about one eighth of an inch, is first passed through a suitable dye so as to form bend 22 from approximately one quarter of the length of bar 12, as shown in FIG. 5-A, which is thereafter advanced to a 180° bend as shown in FIG. 5-B. FIG. 5-A is then formed at the opposite end of bar 12 as shown in FIG. 5-C which is thereafter also advanced to 180° as shown in FIG. 5-D, thus forming a link 36. Thereafter, this link is placed in a squeeze pin and block assembly generally indicated at 40 which is comprised of forming pins 42 and 44 attached to a base plate 46 by any convenient means such as by threads 47.

Blocks 48 and 50 are slidingly retained on base plate 46 by means of rail like extensions 52 formed integrally therewith. The base plate 46 is provided with channels 54 which slidingly receive rails 52. Therefore, metal blocks 48 and 50 are movable toward and away from each other within channel 54 by any convenient means such as a vice, squeeze clamps or hydraulic rams (not shown).

As shown in FIG. 8, a groove 56 is provided on pins 42 and 44 for securely holding the bar 12 in position after it has been placed in position around pins 42 and 44 as shown in FIG. 6 and gripped by blocks 48 and 50.

After the metal blocks 48 and 50 have been brought into engagement with bar 12, they can be moved toward each other as shown in FIG. 7 deforming the bar 12 into the shape shown in FIG. 3. Thereafter, the blocks 48 and 50 will be withdrawn and bar 12 will have been formed into the position as shown in FIG. 3.

The slidable closure member 14 can either be cast or a rectangular block about one inch long, one half inch wide and one quarter inch thick or could be milled in a conventional fashion so as to form grooves 32. Since the casting or milling can be accomplished through conventional techniques known to those skilled in the art, further discussion of either is felt to be unnecessary in explaining the present invention.

While preferred specific embodiment of the invention is hereinbefore set forth, it is to be clearly understood that the invention is not to be limited to the exact instruction design or mechanism illustrated and described because various modifications of these specific details may be provided in putting the present invention into practice, which should also be construed to come within the scope of the appended claims.

I claim:

1. A keyholder comprised of a strip of material, said strip being shaped so as to form a body member having two end portions and a central portion, said end portions being joined together along one side of said central portion, said strip having two free end portions which together form the opposite side of said central portion, said free ends being spaced apart so as to define an opening therebetween, wherein each side of said central portion of said body member has been bent inwardly so as to form a narrowed area therebetween, and closure means for closing the opening in the narrowed area of said central portion, said closure means being slidingly retained by the portions of said strip forming said narrowed area wherein said closure means comprises a rectangular shaped block-like member having two long sides and two short sides, groove means for engaging the sides of said narrowed area, said groove means extending along each of said long sides of said block-like member and wherein the length of the side of said narrowed area along which said end portions are joined is equal to the length of said block-like member and the width of the opening defined by said free ends, and the length of each of said free end portions comprising the opposite side of said narrowed area is equal to about one half the length of said block-like member.

2. A keyholder comprising a body member having two end portions and a central portion, each of said end portions being shaped substantially in the form of a loop, said end portions being integrally joined together along one side of said central portion, said body member being provided with an aperture within the other side of said central portion, closure means for closing said aperture, said closure means being slidably retained between, within and engaging both sides of said central portion wherein said closure means comprises a rectangular shaped block-like member having two long sides and two short sides, groove means for engaging the sides of said central portion, said groove means extending along each of said long sides of said block-like member, and wherein the length of the side of said central portion along which said end portions are joined is equal to the length of said block-like member and the width of said aperture and the length of said body member adjacent each side of the aperture in said central portion is equal to about one half of the length of said block-like member.

3. A process for forming a keyholder comprising the steps of:

bending one end portion of a straight rod into a substantially U-shaped bend;

bending the other end portion of the straight rod into a substantially U-shaped bend thereby forming the rod into a substantially closed C-shaped link such that each end of the rod lie directly opposite each other and one spaces apart so as to define an opening therebetween;

forming a narrowed area in the central portion of the substantially closed C-shaped link while maintaining the edges of the rod forming the interior sides of the narrowed area parallel;

forming a substantially rectangular block-like member having a width equal to the width of the narrowed area in said link and a length substantially equal to the length of each of the free ends of the rod forming one side of the narrowed area;

cutting grooves along the length of the long sides of the rectangular block-like member.

4. A keyholder as claimed in claim 1 wherein said strip is comprised of a square rod bent along a lineal edge and wherein said grooves in said block-like closure member have a V-shaped cross-section.

5. A keyholder as claimed in claim 1 wherein said strip and said block-like closure member are metal.

6. A keyholder as claimed in claim 5 wherein said metal is stainless steel.

7. A keyholder as claimed in claim 1 wherein said strip is stainless steel and said block-like closure member is brass.

8. A keyholder as claimed in claim 1 wherein said strip and said block-like member are plastic.

* * * * *